US005594962A

United States Patent [19]

Bogdanoff

[11] Patent Number: 5,594,962

[45] Date of Patent: Jan. 21, 1997

[54] FLUID FILLED MEDICAL MATTRESS

[76] Inventor: Joseph Bogdanoff, 22 boulevard Meyniel, 47200 Marmande, France

[21] Appl. No.: 446,604

[22] PCT Filed: Sep. 23, 1993

[86] PCT No.: PCT/FR93/00927

§ 371 Date: May 23, 1995

§ 102(e) Date: May 23, 1995

[87] PCT Pub. No.: WO95/08285

PCT Pub. Date: Mar. 30, 1995

[51] Int. Cl.[6] ..... A47C 27/10; A61G 7/057; A61G 7/02

[52] U.S. Cl. ..... 5/422; 5/604; 5/903; 5/685; 5/695

[58] Field of Search ..... 5/451, 450, 453, 5/455, 456, 604, 903, 422, 648, 606

[56] References Cited

U.S. PATENT DOCUMENTS

| | | | |
|---|---|---|---|
| 4,120,062 | 10/1978 | Anderson | 5/451 |
| 4,517,692 | 5/1985 | Vogel | 5/451 |
| 4,974,272 | 12/1990 | Liu | 5/422 |
| 5,020,176 | 6/1991 | Dotson | 5/453 |

FOREIGN PATENT DOCUMENTS

| | | |
|---|---|---|
| 2626467 | 8/1989 | France . |
| 2688695 | 9/1993 | France . |

*Primary Examiner*—Alexander Grosz
*Attorney, Agent, or Firm*—Young & Thompson

[57] ABSTRACT

The subject matter of the invention is a medical mattress comprising a flexible tubular envelope (1) open at two ends, divided into a central section (3*a*, 3*b*) open at both ends and flanked, on either side, by an area forming a border (4*a*, 4*b*; 5*a*, 5*b*) open at both ends, with two sets of foam elements (8) being insertable in the border sections (4*a*, 4*b*; 5*a*, 5*b*) and two small water mattresses (7*a*, 7*b*) being insertable in the central section (3*a*, 3*b*). The elements (7*a*, 7*b*, 8) are arranged substantially symmetrical to the transversal center line (T) of the envelope, while the edges (15) facing the water mattresses (7*a*, 7*b*) have a concavity forming a central basin (16). An opening (17) formed in the upper wall (1*a*) of the envelope (1), in the central portion of said basin (16), is connected to one at least flexible tube for discharging body waste and soiled fluids. A device (14) is provided for supplying water to one and/or the other of the two water mattresses (7*a*, 7*b*) at a regulated temperature and rate/pressure.

7 Claims, 3 Drawing Sheets

FLUID FILLED MEDICAL MATTRESS

FIELD OF THE INVENTION

The present invention relates to an anti-bedsore medical mattress for patients immobilized on their bed.

BACKGROUND OF THE INVENTION

The interest in a medical mattress for immobilized patients is known. It must allow the patient to remain in a prone position in the best conditions of comfort and hygiene.

As much as possible, it must avoid the formation of bedsores by adapting itself to the body of the patient in such a manner as to present a maximal support surface.

For certain bedridden incontinent patients, the mattress must allow for the evacuation of solid and liquid dejecta and facilitate cleansing.

In the area of comfort, to assure a high support surface, it is very natural to resort to mattresses of the hydraulic type, the mattress itself constituting a reservoir of heated and regulated water. One can cite couches or beds using these principles (patents U.S. Pat. No. 3,879,598 and CH-551, 173). Sometimes, the comfort is achieved by controlling the environment, such as using devices assuring a vibratory motion of the water contained in the mattress (U.S. Pat. No. 4,114,215). Sometimes, these particularly comfortable mattresses are not adapted to patients immobilized on their beds. It is one of the reasons for which mattresses or specific devices have been conceived and realized. Most often, they use a case and a reception basin of the dejecta and soiled fluids, which slides in the case (patent FR-A-2,087,040 and CH-259,604).

These mattresses or these devices are not particularly comfortable and do not prevent bedsores.

Although it may appear logical to combine the comfort of a hydraulic mattress with a device allowing the evacuation of the dejecta and soiled fluids, few implementations have resolved the problems posed. One can cite in this area a mattress comprising transverse cushions whose central cushion comprises a cavity to collect and evacuation the dejecta (patent FR-A-932,263). A mattress implementing two air and water circuits whose water portion is removable ensures a good comfort to the bedridden patient and, at the same time, facilitates his hygiene (patent FR-A-2,626,467).

Although this last-mentioned mattress addresses to a great extent the known problems, its use is delicate because it comprises the implementation of two fluid systems, air and water. Its use, in private homes as well as in the hospital environment, lacks simplicity. Moreover, if it is a clear improvement with respect to the existing mattresses and devices, it does not completely prevent bedsores.

For the following reasons, the medical mattress for patients bedridden for long periods, or for incontinent bedridden patients must not only be comfortable and avoid bedsores while allowing a hygiene close to that of normal life, but it must, in conception, be robust and simple in its implementation and use by nonspecialized personnel.

SUMMARY OF THE INVENTION

The invention aims precisely to propose such a mattress.

To this effect, the invention has for its object a medical mattress comprised of:

a rectangular flexible tubular envelope open at two ends, divided into a central compartment extending along the longitudinal axis of the envelope, open at both ends and flanked, on either side, by a relatively narrow lateral compartment forming a border, also open at both ends;

two sets of foam elements adapted to be inserted in the border compartments;

two small water mattresses adapted to be inserted in the central compartment, the foam elements and water mattresses being disposed in the envelope in a substantially symmetrical manner with respect to the central transverse axis of the envelope, while the edges facing the water mattresses have a concavity forming a basin in the central zone of, and transversely to, the medical mattress;

an opening formed in the upper wall of the envelope, in the central part of said basin, connected at least to a flexible tube disposed within the envelope and terminating outside the mattress for discharging the body waste and soiled fluids;

and a device for supplying water to one and/or the other of the two water mattresses at a regulated temperature and rate/pressure.

According to a preferred embodiment, each water mattress is formed by a flexible mattress having several compartments communicating with each other by one or many orifices, the water entering and leaving at the level of two compartments at the far ends of said envelope, while the water supply at a predetermined adjustable pressure is effectuated according to a programmable cycle comprising a water supply phase of the supply device in the water mattresses at a predetermined adjustable rate, and a free return phase, at a predetermined adjustable rate, of the water from the mattresses towards the water supply device.

Such a mattress permits instantaneously adjusting the extent of the central basin by positioning each water pressure in the interior of its housing defined by the central section of the envelope, by relative displacement of the mattress along the longitudinal axis of the envelope, such as to bring closer or further apart the two concave edges of the two water mattresses.

In addition, according to an essential characteristic of the device according to the invention, the successive inflating and deflating cycles of the water mattresses results in micromovements at the surface of each of said mattresses, which favors the vascularization of the bedridden patient and prevents the eventual formation of bedsores.

The modular structure comprised, on one hand, by the compartmentalized envelope, and, on the other hand, by the foam assembly and the removable water mattresses, allows to optionally incline the head half-portion of the mattress, or the feet half-portion of the mattress, one with respect to the other. It also permits to fold the mattress in two so as to carry it away, or to completely roll the envelope after having taken out all of the removable parts.

BRIEF DESCRIPTION OF THE DRAWINGS

Other characteristics and advantages of the invention will be apparent from the following description of an embodiment of the medical mattress according to the invention, which description is only given as example, and in regard to the annexed drawings in which.

DESCRIPTION OF THE PREFERRED EMBODIMENTS

Figure 1:
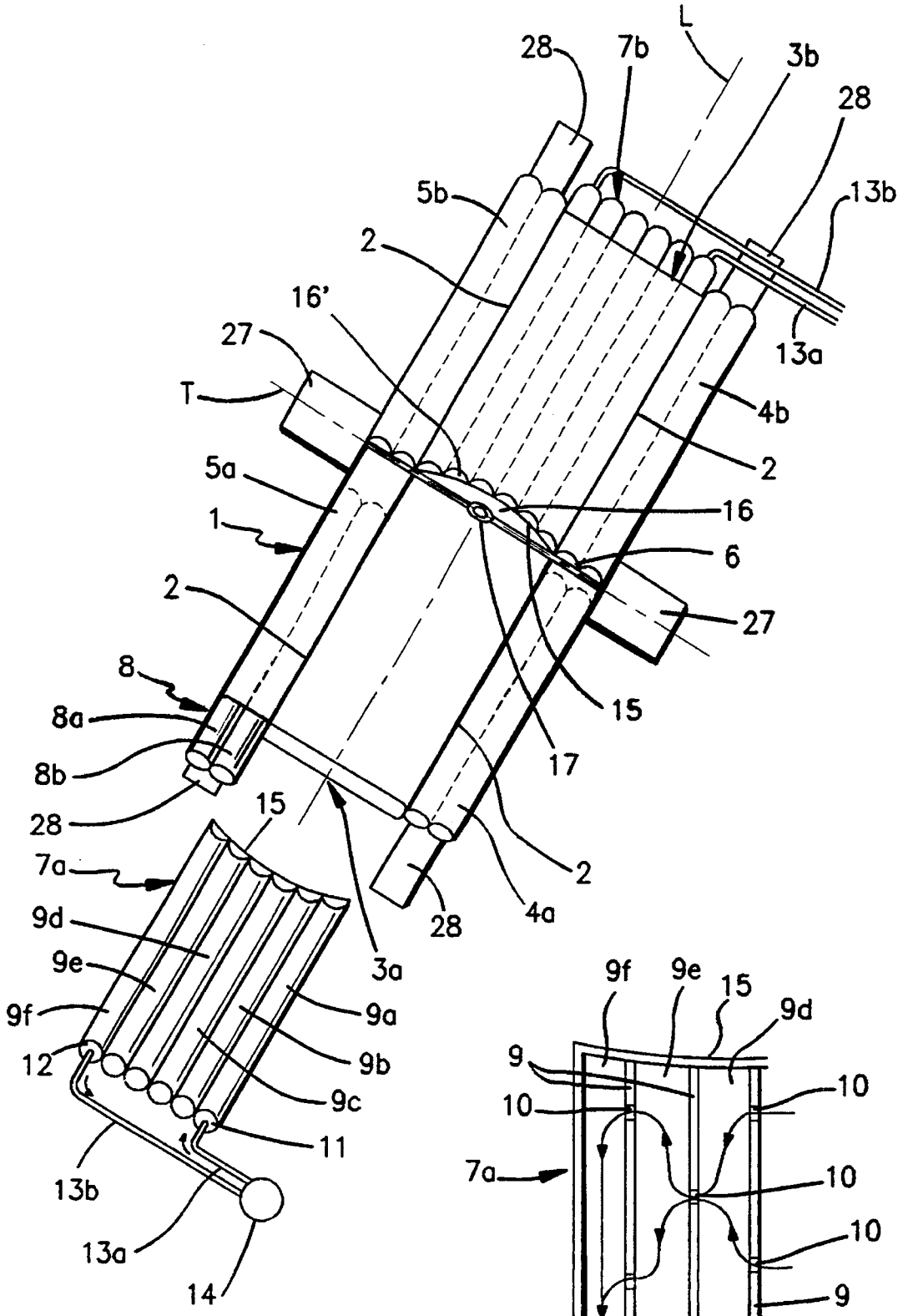
FIG. 1 is a perspective schematic view of a medical mattress according to a preferred embodiment of the invention.
Figure 3:
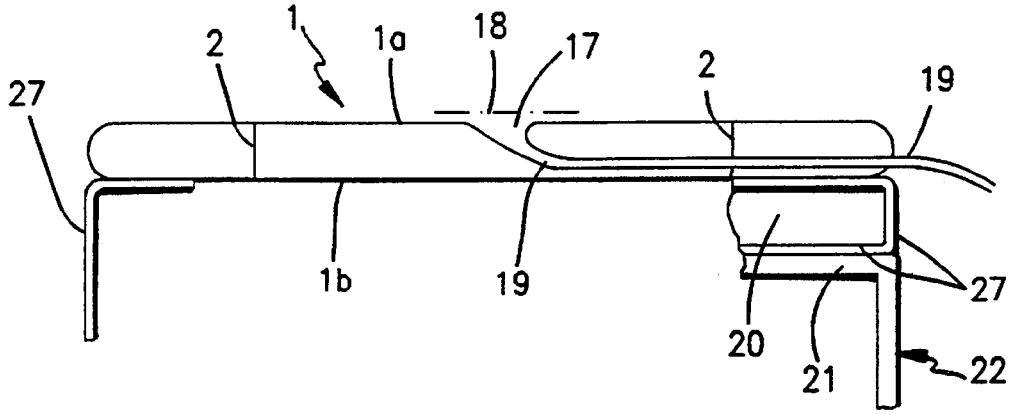
FIG. 3 is a schematic view in transverse cross section along the axis T of the medical mattress of FIG. 1, installed on a bed.
Figure 4:
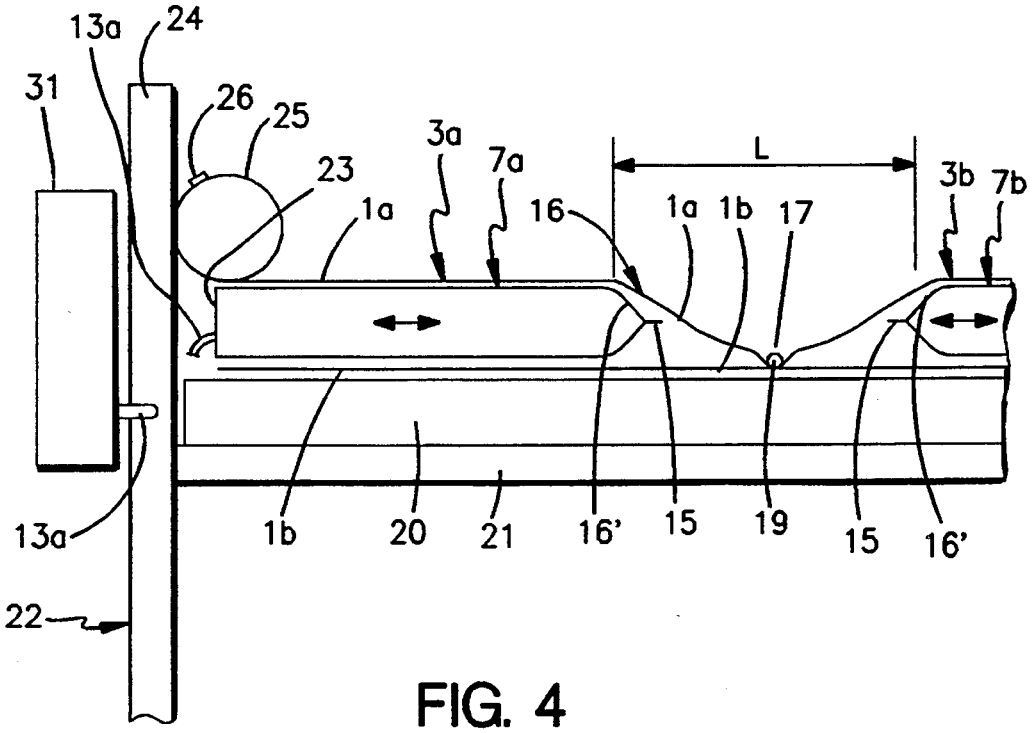
FIG. 4 is a schematic view in partial cross section along the axis L of the medical mattress of FIG. 1, installed on a bed.

Represented as reference numeral 1 in FIGS. 1, 3 and 4 is a flexible tubular envelope, in rectangular form, open at its two extremities. The envelope 1 is, for example, made of a folded sheet of stock polyvinyl chloride and thermobonded to form a flat tube.

Using, for example, welds, this envelope 1 is divided into compartments to delimit by two lines of welds or partitions 2 parallel to the longitudinal edges of the rectangular envelope 1, on one hand, a central compartment (3*a*, 3*b*) extending in the longitudinal axis L of the envelope 1, and open at two ends of the latter and, on the other hand, two lateral compartments (4*a*, 4*b* and 5*a*, 5*b*), bordering the mattress, also open at both ends of the envelope 1.

For a mattress having dimensions of, for example, 90 cm×190 cm, the central compartment (3*a*, 3*b*) of the envelope 1 has a width on the order of 55 to 60 cm and each border compartment (4*a*, 4*b*; 5*a*, 5*b*) has a width on the order of 15 to 17.5 cm.

The envelope 1 is, either fictitiously, or actually with a thermobonding line as illustrated as reference numeral 6 in FIG. 1, along the transverse axis T of the envelope 1, divided in two half-portions, called head half-portion and feet half-portion.

Therefore, fictitiously or not, the central compartment is divided in two parts 3*a*, 3*b* and the two edge compartments are each divided in parts 4*a*, 4*b* and 5*a*, 5*b*, respectively.

Each half central compartment 3*a*, 3*b* forms a pocket in the opening of which may be inserted a small water mattress 7*a*, 7*b*, respectively.

In FIG. 1, a water mattress 7*a* is represented from outside the envelope 1, ready to be inserted in the compartment or pocket 3*a*, and the other mattress 7*b* is represented completely inserted in the compartment or pocket 3*b*.

Each tubular compartment 4*a*, 4*b*, 5*a*, 5*b* is, moreover, adapted to receive an element 8 of a foam material, for example polyurethane foam, or of a block, of approximately rectangular section, or, as represented in the drawings, constituted by two sections of filled associated tube 8*a*, 8*b*.

In FIG. 1, are two associated sections of foam 8*a*, 8*b* of the compartment 5*a* partially removed from this latter, whereas in the other compartments (4*a*, 4*b*, 5*b*), the elements 8*a*, 8*b* in foam material are completely inserted.

The dimensions of the elements 8 are determined in such a manner that they slide with gentle friction in their tubular housing and occupy it completely.

The water mattresses 7*a*, 7*b* have a flexible structure, are deformable, and have a width such that once inserted in their compartment 3*a*, 3*b*, the pressure of the water in the mattress 7*a*, 7*b* forces the wall of the mattress against the internal wall of the compartment 3*a*, 3*b*, and keeps the water mattress from any untimely displacement once in place in the envelope 1.

Figure 2:
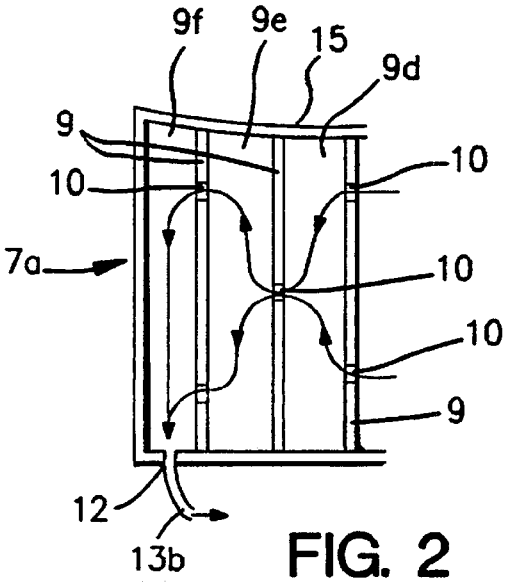
FIG. 2 is a partial schematic view of a small water mattress of the device of FIG. 1.

According to a preferred embodiment of the water mattresses 7*a*, 7*b*, they are constituted, as illustrated in FIGS. 1 and 2, by a flexible thermoplastic compartmentalized, for example, by welding lines or partition 9, in juxtaposed compartments 9*a*, 9*b*, 9*c*, 9*d*, 9*e*, 9*f*, communicating between themselves by passage orifices 10. The two far compartments 9*a* and 9*f* comprise an orifice, of water inlet 11 and water outlet 12, respectively, connected by supple tubing 13*a*, 13*b* to a source 14 of supply of water at a regulated temperature as well as rate/pressure.

According to an important characteristic of the device of the invention, the anterior edge 15 (side at the center of the envelope 1) is concave such that once the two water mattresses 7*a*, 7*b* are completely engaged in their compartments 3*a*, 3*b*, the two edges 15 facing the two mattresses 7*a*, 7*b* define a basin 16 of lenticular form, in the central zone of the medical mattress, said basin 16 having its axis aligned with the transverse axis T of the envelope 1.

Preferably, the end part of the mattress 7*a*, 7*b* facing the basin 16 has an inclined side 16' to give the basin a flared configuration.

At the center of this basin 16, preferably in the upper wall of the envelope 1 (see also FIGS. 3 and 4), an orifice 17 optionally closable with, for example, a perforated medical adhesive strip 18 and connected to a flexible tubing 19 disposed between the two walls of the envelope 1 and having an outlet at the exterior of the medical mattress, at the side at the level of the basin 16. The tubing 19 is not shown in FIG. 1, and in FIGS. 3 and 4, the envelope 1 does not comprise a welding line 6 between the upper wall 1*a*, and the lower wall 1*b*.

In FIGS. 3 and 4, the medical mattress is represented on a conventional mattress 20 which is preferably a hard mattress, resting on the metallic inner spring 21 of a bed 22.

As depicted in FIG. 4, the central basin 16 whose width 1 may be adjusted by displacing the water mattresses 7*a*, 7*b* to the interior of the compartments 3*a*, 3*b*, in the axis L, so as to separate or contrarily to bring closer the two edges 15 disposed on either side of the dejecta and soiled fluid evacuation orifice 17. The displacement of the water mattresses 7*a*, 7*b* is possible in view of the distance separating the posterior edges 23 of the mattresses from the head and feet panels 24 of the bed 22.

In FIG. 4 is also represented at 25, a tubular element, made, for example, of the same material as the envelope 1 and welded at the extremity of the upper wall 1*a* of the compartment 3*a*. The tubular element 25 may be filled with water, in particular hot water, and comprises for this purpose, two suitable closable joints 26, disposed at the ends of the element 25. The element 25 extends only along the width of the compartment 3*a*, and serves to prop up and to eventually heat the feet of the patient lying on the mattress. The element 25 may be emptied of its water and partially folded under the medical mattress if not used. The water of the element 25 is supplied from the device 14, or independently of this device.

Also, represented in the central zone of the mattress, on either side of the basin 16, are flexible legs 27 foldable under the mattress 20 (FIG. 3) to better laterally prop up the medical mattress on the bed. Such legs 27 can be located at the two ends (at the head and at the foot) of the mattress.

FIG. 1 also depicts other flexible legs 28, disposed in the axis L and not in the axis T as is the case with the legs 27, and intended to prop up the medical mattress on the bed 22, in the lengthwise direction, this being useful, in particular, when the bed or a part of the bed is inclined. Such legs 28 are not shown in FIG. 4.

Figure 5A:
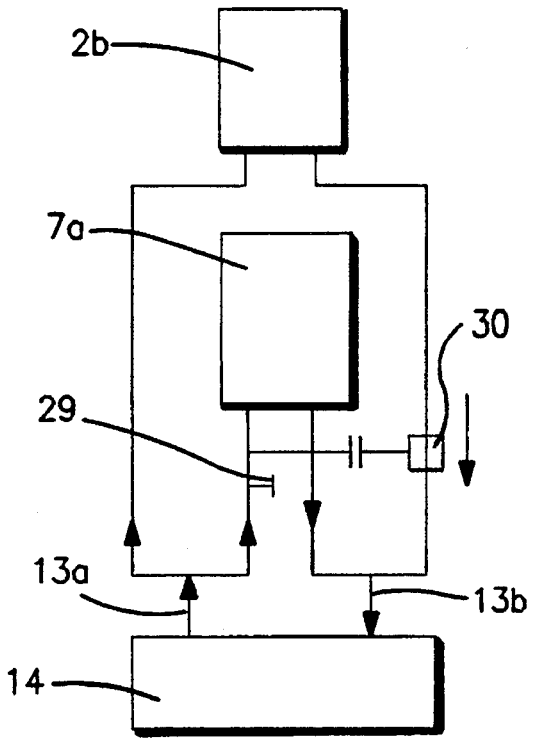
FIGS. 5*a* and 5*b* depict two modes of connecting the two small water mattresses to the device for supplying regulated water.
Figure 5B:
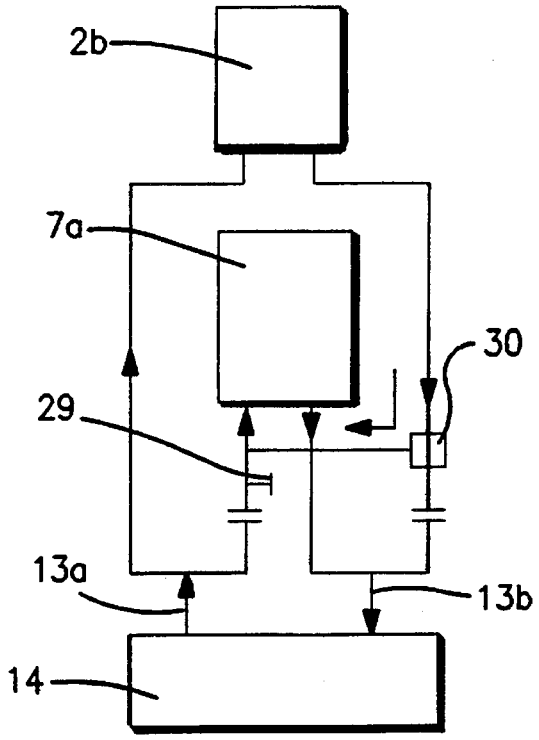

Two modes of water circulation in the two water mattresses 7*a*, 7*b*, from the source 14 are illustrated in FIGS. 5*a* and 5*b*.

In FIG. 5*a*, the setup allows to feed, in parallel, the mattresses 7*a* and 7*b*, whereas in FIG. 5*b*, the mattresses 7*a*, 7*b* are fed in series.

Passing from one mode to another is carried out by a set of valves or faucets having one or several channels 29, 30 disposed in the appropriate branches of the circuit.

Figure 6:
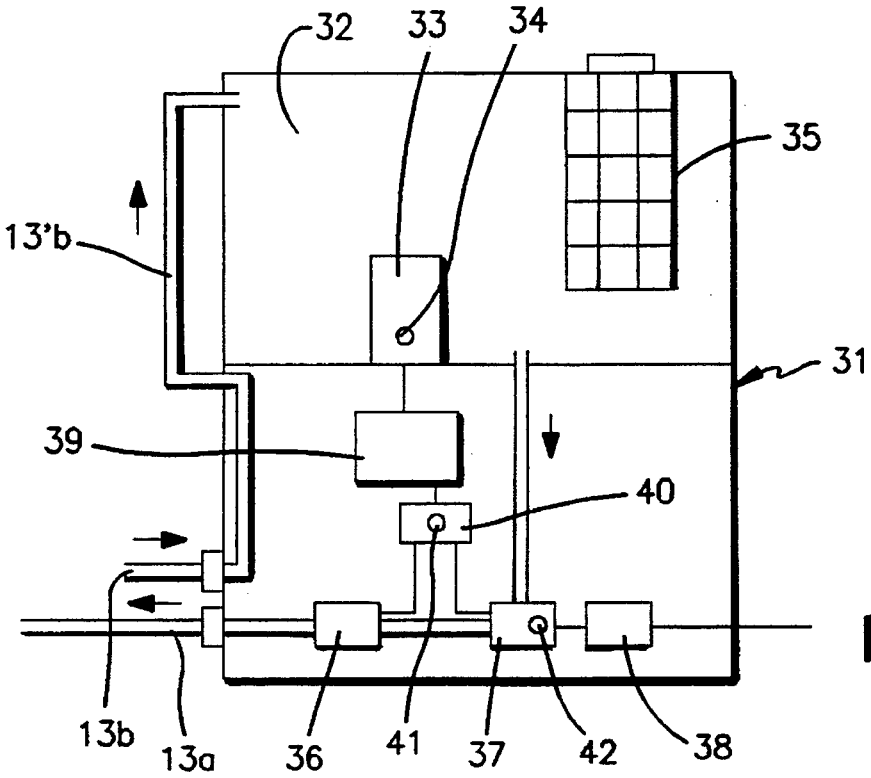
FIG. 6 is a functional schematic of a device for supplying regulated water, according to a preferred embodiment.

Lastly, FIG. 6 depicts a schematic and functional device for supplying water at a regulated temperature and rate/pressure according to the invention.

This device comprises a certain number of components advantageously grouped in a cabinet-chest 31 for example hitched to the foot 24 of the bed and connected by the tubings 13*a*, 13*b* to the water mattress 7*a*, 7*b*.

These components comprise a water reservoir 32, a controllable electrical heating device 33 having a temperature display 34 disposed therein, and a basket 35 adapted to receive ice cubes.

An electrovalve 36 and a pump 37 actuated by an electric motor 38 are disposed in the supply circuit (13*a*) of the mattresses 7*a*, 7*b* from the reservoir 32.

A programmable microprocessor 39 is connected to the heating device 33, to the electrovalve 36, and to the pump 37, via a timing device 40 and controls the cycles of water supply towards the mattresses 7*a*, 7*b*, and the rest cycles during which the pump is not in service and the water of the mattresses 7*a*, 7*b* returns, by gravity, particularly under the weight of the patient lying on the medical mattress, to the reservoir 32. The dimensions of the water circuits and the functional parameters (rate/pressure of water and duration, respectively, of water supply by the pump 37 and gravitational return of the water toward the reservoir 32) are determined such that at no give time are the mattresses 7*a*, 7*b* completely deflated, or to the contrary over inflated.

The timing device 40 and the pump 37 are provided with means 41, 42 for precise timing and for regulating the rate/pressure, respectively.

The ice cube basket 35 allows, by eliminating the heating of the water in the reservoir 32, to lower, if desired, the temperature of the water sent to the mattresses 7*a*, 7*b*.

A part 13'*b* of the tubing of the water return to the exterior of the chest 31 is shown in FIG. 6. This part 13'*b* is of a transparent or translucent material to allow visual control of the water circulation.

It is understood that one may use two independent water circuits for the mattresses 7*a*, 7*b*. It is in this manner that the two mattresses may be supplied with water having different temperatures.

It bears noting that the passage orifices 10 are calibrated and disposed so as to be in greater number on the side of the edge 15 and force the water to circulate well around the central basin 16.

The water circulation cycles by the pump 42 and by return gravity can be separated by regulated time intervals during which no circulation of water occurs, the mattresses 7*a*, 7*b* remaining static.

Following successive cycles, the mattresses 7*a*, 7*b* inflate and deflate, which translates into micromovements at the surface of each of said mattresses, which promotes the vascularization of the bedridden patient and prevents the eventual formation of bedsores.

The two half-portions, head and feet, of the envelope 1 may be separated by the transverse welding line 6 or a partition arranged between the walls 1*a* and 1*b*. The tubing 19 may be doubled by another similar tubing directed at the other side of the mattress, the one or several tubings 19 being disposed between the walls 1*a*, 1*b*.

It is understood that the shapes and the dimensions of the foam elements 8 and the water mattresses 7*a*, 7*b* may be varied, as well as the internal structure of the water mattresses.

I claim:

1. Medical mattress comprising:

a flexible rectangular tubular envelope having two open ends, and divided into a central compartment extending along a longitudinal axis of the envelope, said central compartment being open at both ends and being flanked, on either side, by a relatively narrow lateral compartment forming a border also open at both ends;

two sets of foam elements adapted to be inserted in the lateral compartments;

two small water mattresses having edges and adapted to be inserted into said central compartment, said foam elements and said water mattresses being disposed in the envelope in a substantially symmetrical manner with respect to a central transverse axis of said envelope, and said edges having a concavity which forms in a central zone, and transversely to, said medical mattress, a basin;

an opening formed in an upper wall of the envelope in a central part of said basin, connected to at least one flexible conduit disposed within the envelope and emerging outside the mattress for discharging body waste and soiled fluids; and a supply device for supplying water to at least one of the two water mattresses at a regulated temperature and pressure.

2. Medical mattress according to claim 1, wherein each water mattress is made of a flexible envelope having several compartments communicating amongst themselves by at least one orifice, the water entering and leaving at the level of two end compartments of said envelope, and the supply device supplying water under a predetermined adjustable pressure according to a programmable cycle comprising a water supply phase to the water mattresses, and a water return phase toward the water supply device.

3. Medical mattress according to claim 1, wherein the envelope has two walls which are connected to each other by one of a welding line and a partition at the level of the central transverse axis.

4. Medical mattress according to claim 1, wherein the envelope has edges which are provided with foldable flexible legs for propping up the medical mattress longitudinally and laterally.

5. Medical mattress according to claim 1, wherein the water supply device comprises a cabinet-chest enclosing a water reservoir, a water heating device, a pump actuated by motor means, an electrovalve, a timing device, and a programmable microprocessor, said microprocessor being connected to the heating device, to the pump, to the electrovalve, and to the timing device, said cabinet-chest being connected to the water mattresses by fluid circuits including flexible tubing and valve means for selectively circulating water from said water reservoir to said water mattresses, and back to the water reservoir.

6. Medical mattress according to claim 5, wherein the water reservoir comprises a basket for storing ice cubes to cool the circulating water.

7. Medical mattress according to claim 1, wherein the envelope is divided along the central transverse axis into a head half-portion and a foot half-portion, and a central part of the foot half-portion of the envelope is extended by an inflatable heatable flexible tubular element for propping up and heating feet.

* * * * *